United States Patent [19]

Tsuhako

[11] 4,377,194

[45] Mar. 22, 1983

[54] TILT AND LIFT MECHANISM FOR VENETIAN BLIND

[75] Inventor: Parker I. Tsuhako, Gardena, Calif.

[73] Assignee: Ohline Corporation, Gardena, Calif.

[21] Appl. No.: 199,113

[22] Filed: Oct. 20, 1980

[51] Int. Cl.[3] ..... E06B 9/30

[52] U.S. Cl. ..... 160/168 R; 160/172; 160/176 R

[58] Field of Search ..... 160/166-176

[56] References Cited

U.S. PATENT DOCUMENTS

| | | | |
|---|---|---|---|
| 1,063,042 | 5/1913 | Krueger | 160/172 |
| 1,845,574 | 2/1932 | Agee | 160/176 R |
| 1,949,653 | 3/1934 | Moore | 160/170 |
| 2,003,174 | 5/1935 | Cooper | 160/176 R |
| 2,017,541 | 10/1935 | Kuyper | 160/176 R |
| 2,158,454 | 5/1939 | Zubiria | 160/172 |
| 2,223,633 | 12/1940 | McKerlie | 160/176 R |
| 2,580,479 | 1/1952 | Stogran | 160/176 |
| 2,582,301 | 1/1952 | Walker | 160/174 |
| 2,687,770 | 8/1954 | Walker et al. | 160/176 R |
| 3,100,013 | 8/1963 | Randmark | 160/168 |
| 3,122,198 | 2/1964 | Nelson | 160/176 |
| 3,190,346 | 6/1965 | Arena et al. | 160/172 |
| 3,192,784 | 7/1965 | Cayton | 160/168 |
| 3,294,153 | 12/1966 | Fountain | 160/168 R |
| 3,455,364 | 7/1969 | Fukuoka | 160/176 |
| 3,795,266 | 3/1974 | Debs | 160/168 |

*Primary Examiner*—Peter M. Caun

*Attorney, Agent, or Firm*—Henry M. Bissell

[57] ABSTRACT

A venetian blind slat-tilting mechanism including a pair of top-mounted bars to which tilt strings are attached at opposed positions and which are attached together through a nut threaded to a rod. The rod is connected to a pulley which is turned by a tilt-adjusting cord. The motion of the pulley turns the rod and moves the nut laterally, thus moving both bars and tilting the blind's slats. Additionally a slat-lifting mechanism is provided in the form of lift strings running over support pulleys to raise and lower the blind.

25 Claims, 13 Drawing Figures

TILT AND LIFT MECHANISM FOR VENETIAN BLIND

BACKGROUND OF THE INVENTION

1. Field of the Invention

The present invention relates to Venetian blinds and, more particularly, to a mechanism for tilting and raising and lowering such blinds.

2. Description of the Prior Art

Venetian blinds, once popular forty or fifty years ago, are now coming back into use in custom installations. Most often the blinds are used in homes in the medium to upper price brackets and in offices and institutions after having been substantially displaced by other sunshading and privacy devices.

Normally, Venetian blinds comprise a plurality of slats or louvers supported, at least toward the opposite ends of the slats, by so-called ladders comprising a pair of angle or tilt control strings located on opposite sides of the slats and a lift string extending vertically through the center of the slats. Extending generally horizontally between the tilt strings and spaced vertically in accordance with the width of the slats, are a series of cross strings or tapes which serve to support the respective slats in an appropriately spaced relationship. Each slat is, of course, provided with a central opening through which the lift string extends. The opening is elongated in the transverse direction of the slat in order to permit the slats to be tilted through a substantial angle to permit opening and closing the blind without interference between the slats and the lift strings.

By varying the vertical position of the tilt strings of a single ladder with respect to each other—and thereby the angles of the cross tapes extending between them—the slats are rotated in unison, thereby opening and closing the blind. The blind may be lifted entirely to the top of the associated window or other space where it is installed by causing the lift string to be pulled upwardly, as over a pulley arrangement in the head piece of the blind, thereby lifting the bottom rail of the blind and pulling all of the slats up with it as the slack is taken up in the lift string. It can be readily seen that the mechanisms for raising and lowering, as well as the mechanism for tilting the slats, normally contained in the headrail, must be designed in a manner to function effectively and yet be compact and simple.

Moore in U.S. Pat. No. 1,949,653 and Cooper in U.S. Pat. No. 2,003,174 disclose arrangements for controlling the angle of the tilt in the Venetian blind slats. These two arrangements are typical of the type in which a tilt rail is supported below the headrail and controlled so as to vary the tilt of the slats suspended from the tilt rail. U.S. Pat. No. 2,017,541 of Kuyper and U.S. Pat. No. 2,223,633 of McKerlie disclose another conventional means of constructing Venetian blinds in which the upper ends of each ladder are wound around rods in opposite directions. Thus the rotation of both rods in one direction causes tilting of the slats.

Randmark in U.S. Pat. No. 3,100,013 and Fountain in U.S. Pat. No. 3,294,153 both disclose the concept of utilizing horizontal top-mounted bars attached to the tilt strings. In Randmark, the mechanism is a flexible band or tape which can be reciprocated in response to pull strings. In Fountain, on the other hand, the bars move in opposite directions with a pulley being provided to transmit tension from one bar to the other.

Numerous other prior art mechanisms are known; for instance, see Krueger U.S. Pat. No. 1,063,042; Walker et al U.S. Pat. No. 2,687,770; Walker U.S. Pat. No. 2,582,301; Agee U.S. Pat. No. 1,845,574; and Zubiria U.S. Pat. No. 2,158,454. None of these systems, insofar as can be determined, deals with the problem solved by the present invention.

SUMMARY OF THE INVENTION

The present invention incorporates a new tilt and lift mechanism into a standard type of Venetian blind. Standard Venetian blinds, as before described, have plural slats with ladder-like tilt mechanisms mounted adjacent both ends of the structure. The lift mechanism includes a cord which passes through the holes in the slats, traverses the headrail, and becomes the cord which is used to raise and lower the unit.

In the apparatus of the present invention, the conventional channel-shaped headrail is provided with a pair of holes at one end for the tilting cord. The tilting cord is wrapped around a pulley which is directly connected to a rod or shaft. The shaft is provided with screw threads and is rotated by motion of the pulley. A carrier, which is essentially an oversized nut, is mounted on the shaft and thus moves laterally with rotation of the shaft. The shaft and carrier are positioned securely within a housing. The carrier is connected to one or more drive members which substantially traverse the length of the headrail. In one embodiment these members comprise a pair of tilt bars which are further interconnected at the opposite end of the headrail and guided by rollers so that rotation of the pulley attached to the tilt cord moves the bars within the headrail. The tilt ladder described above is attached directly to the bars after having passed through holes in the bottom of the headrail and over the tilt bar guide rollers. One of the ladder cords is attached to one bar on one side of the headrail and the other is attached to the second bar at the other side of the headrail. The connections are positioned so that, when the bars are moved laterally, the connection point for one of the tilt ladder cords moves toward its related hole and the cord is lowered, while the other ladder cord moves away from its associated hole and the cord is raised. In this manner, the slats of the Venetian blind may be tilted in either direction about their longitudinal axes.

A cradle and associated pulleys are used in the headrail assembly at the point where the tilt ladder is attached to the bars. The utilization of the threaded rod and carrier assembly provides the mechanical advantage needed for heavier blinds and, eased by the action of the pulleys, provides for easy and accurate operation of the Venetian blind of the present invention. In addition, the threading on the rod does not extend throughout the whole length of the rod so that when the carrier is rotated to a point where the slats are tilted at their maximum vertical angle, the carrier is released from engagement with the threading on the rod. Thus, further turning of the pulley by the tilt cord merely turns the shaft without driving the carrier and thus does not bind the tilt mechanism. However, the load on the tilt mechanism inherently biases the carrier to re-engage the threading on the rod as soon as the tilt pulley is rotated in the opposite direction.

Additionally, the blind lifting operation is effected by a plurality of lift cords attached to the bottom of the blind and extending through holes in each slat at the respective tilt ladder positions in conventional fashion.

These lift cords pass through the headrail over pulleys which are also used to support and position the tilt bar rollers. The lift cords exit the headrail near one side of the Venetian blind. These pulleys in the lifting mechanism advantageously provide a reduction in the force required to lift the slats and thus present a further improvement over the prior art.

In an alternative arrangement of the tilt drive mechanism, the drive members comprise a plurality of elements hooked together in the number needed to accommodate the width of a particular Venetian blind. Additional elements may be included for wider Venetian blinds, as desired. These elements are hooked together to operate effectively in both tension and compression as the drive mechanism is driven from side to side within the headrail in response to rotation of the tilt pulley and shaft.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENTS

Figure 1:
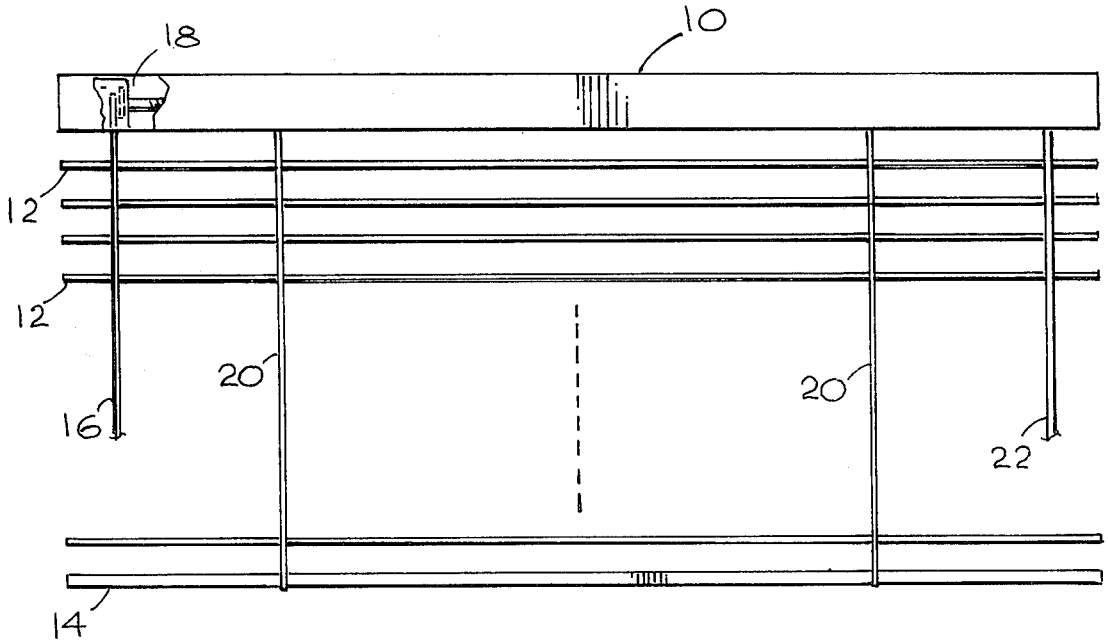
FIG. 1 is an overall schematic of a Venetian blind.
Figure 10:
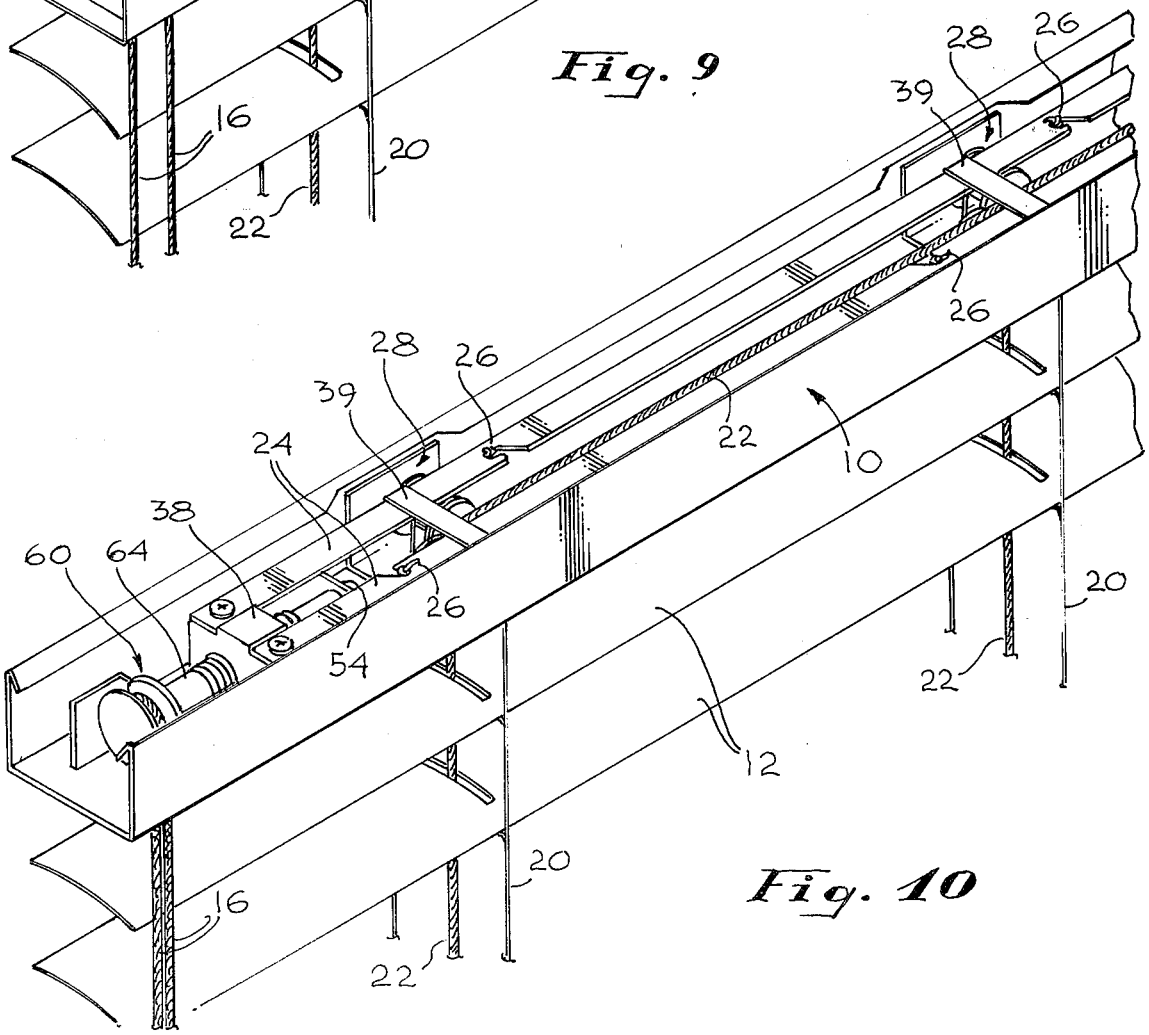
FIG. 10 is an open isometric view (headrail cover and end removed) showing the interrelationship of the various mechanisms making up the embodiment of FIGS. 2–7C.

In FIG. 1 the Venetian blind illustrated has headrail 10, slats 12 and bottom rail 14. Tilt cord 16 is connected to tilt drive mechanism 18, illustrated in more detail in FIG. 5. Tilt ladders 20 are connected to the tilt mechanism which is shown in more detail in FIGS. 6 and 7A–7C. The overall mechanism is shown in FIG. 10. The ends of tilt strings 16 are alternatively pulled to operate drive mechanism 18, and adjust ladders 20 during operation of the Venetian blind. This results in the opening and closing of the blinds. Lift strings 22 include portions which run between ladders 20, and thus when the lift string is pulled downward it traverses a pulley in cord lock mechanism (not shown) and the whole slat mechanism is raised by virtue of the two connections of lift strings 22 to bottom rail 14.

Figure 2:
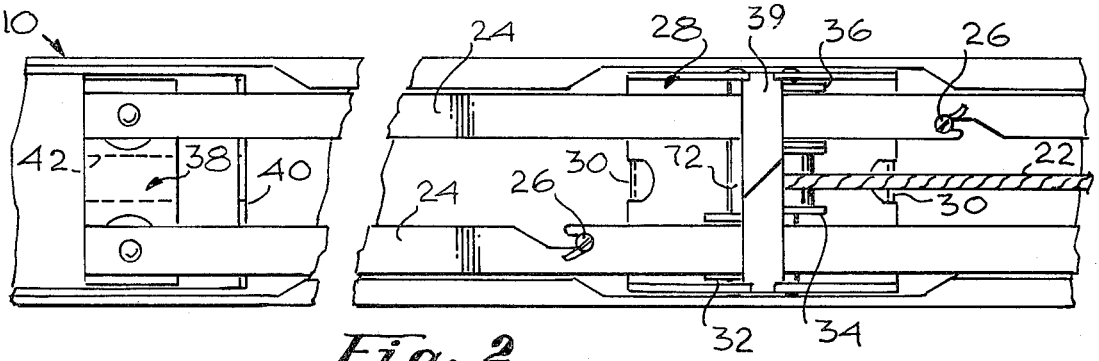
FIG. 2 is a fragmentary plan view of the tilt and lift mechanisms at the tilt ladder.

In FIG. 2 the ends of one of the tilt ladders 20 of FIG. 1 are shown connected to tilt bars 24 through anchor beads 26. Headrail 10 has cradle 28 positioned within it by tabs 30. Cradle 28 is utilized to position pulleys 32, 34 and 36 which position and support tilt bars 24 and lift and ladder strings 22, 44, 48 and permit rolling of the lift and tilt ladder strings (shown underneath the tilt bars 24 in FIGS. 3 and 4) for ease of operation. Cradle 28 is also provided with keeper 39 which prevents tilt bars 24 and lift cord 36 from becoming disengaged. Tilt bars 24 are connected at the left of the drawing to carrier 38 which sits in drive mechanism cradle 40. The carrier is also provided with a threaded hole 42 which is used to cause lateral movement of carrier 38.

Thus, in operation, lateral movement of carrier 38 moves tilt bars 24. The motion of the tilt bars moves one of the anchored tilt ladder cords toward its associated pulley, and the other away from its pulley. The result is the tilting of the slats resting on the ladder. The movement of the carrier in the opposite direction, of course, results in the opposite motion. Further, in operation, pulling of lift cord 22 rotates it over pulley 34 and lifts all of the slats, while releasing of the lift cord lowers them.

Figure 3:
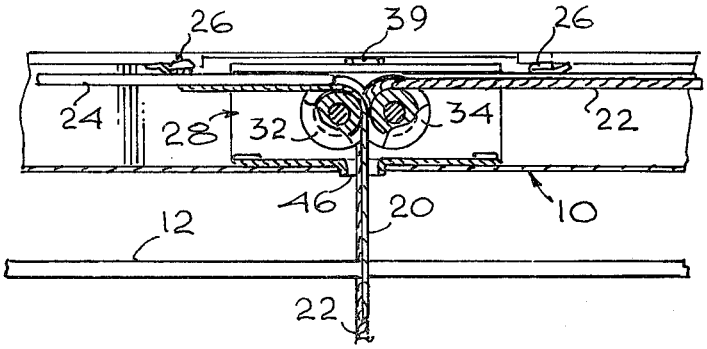
FIG. 3 is a fragmentary sectional side view of the tilt and lift mechanisms.

In FIG. 3 the side view shows the connection between anchor beads 26 and ladder 20 showing ladder string 44 passing over pulley 32. As can also be seen, both the ladder and the lift cord pass through orifice 46 in cradle 28, extending through headrail 10, and headrail 10 positions cradle 28 for operation.

Figure 4:
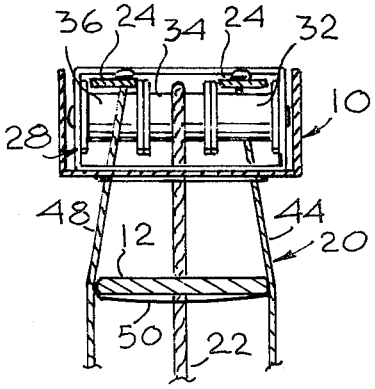
FIG. 4 is a sectional end view of the tilt and lift mechanisms.

FIG. 4 shows the geometry of the system in more detail, with lift cord 22 traversing pulley 34 and ladder strings 44 and 48 traversing pulleys 32 and 36 and being connected to tilt bars 24. Further, traverse string 50 between ladder strings 44 and 48 to form the ladder and retain slat 12 in place is clearly shown.

Figure 5:
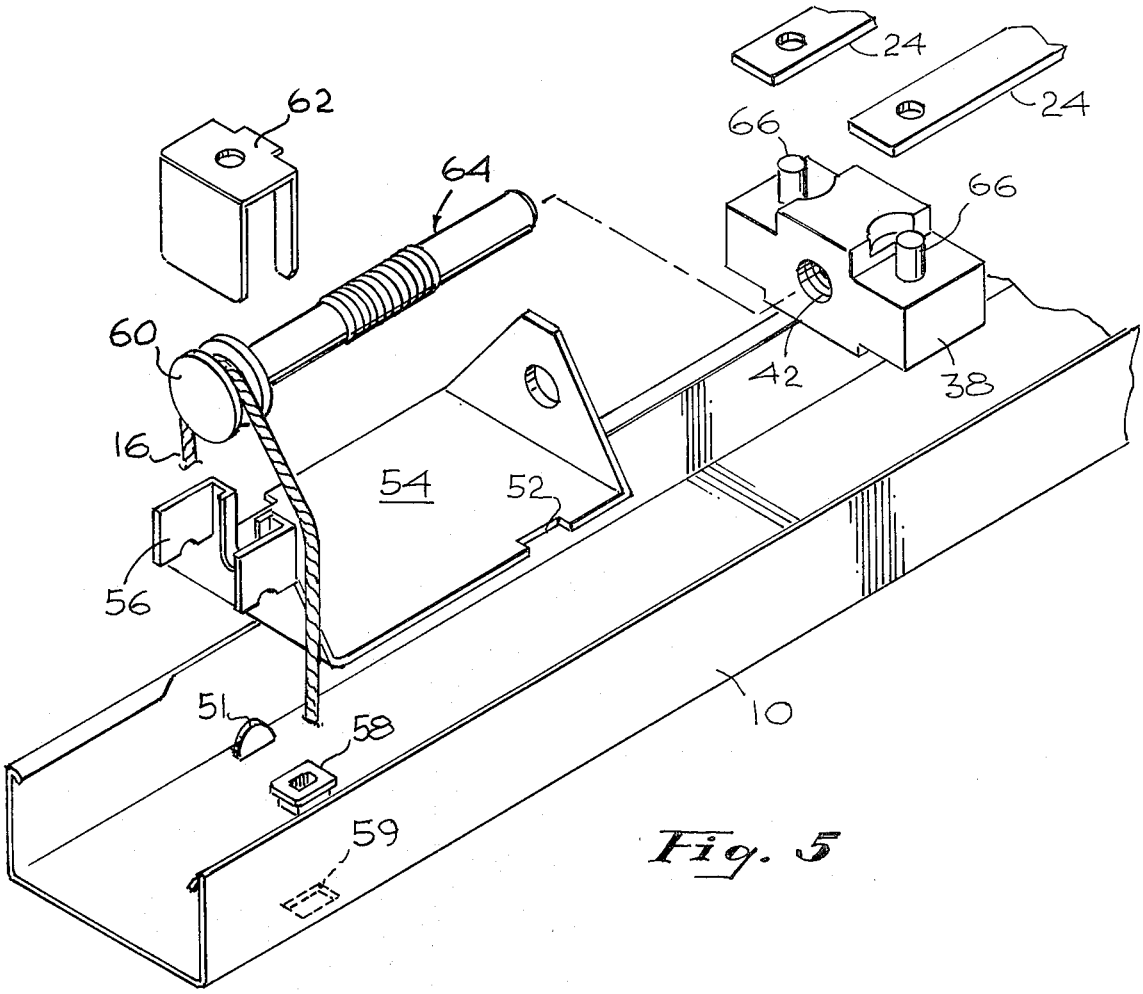
FIG. 5 is an exploded view of the tilt control mechanism.

In FIG. 5, headrail 10 is provided with tabs 51 for engaging slots 52 to position housing 54 in place. The housing is provided with pulley mount 56, and slots 52 and housing 54 are positioned so that tilt string 16 passes vertically through the orifice of cord bushing 58 mounted in headrail 10 at opening 59. Further, pulley 60 is coupled to tilt string 16 and held in position in housing 54 by cover 62. Pulley 60 is also attached to threaded rod 64 which is mounted through carrier 38 at threaded orifice 42, as described above, prior to positioning in housing 54. Carrier 38 is provided with posts 66 which position and retain tilt bars 24 in place so that they operate as described.

Figure 6:
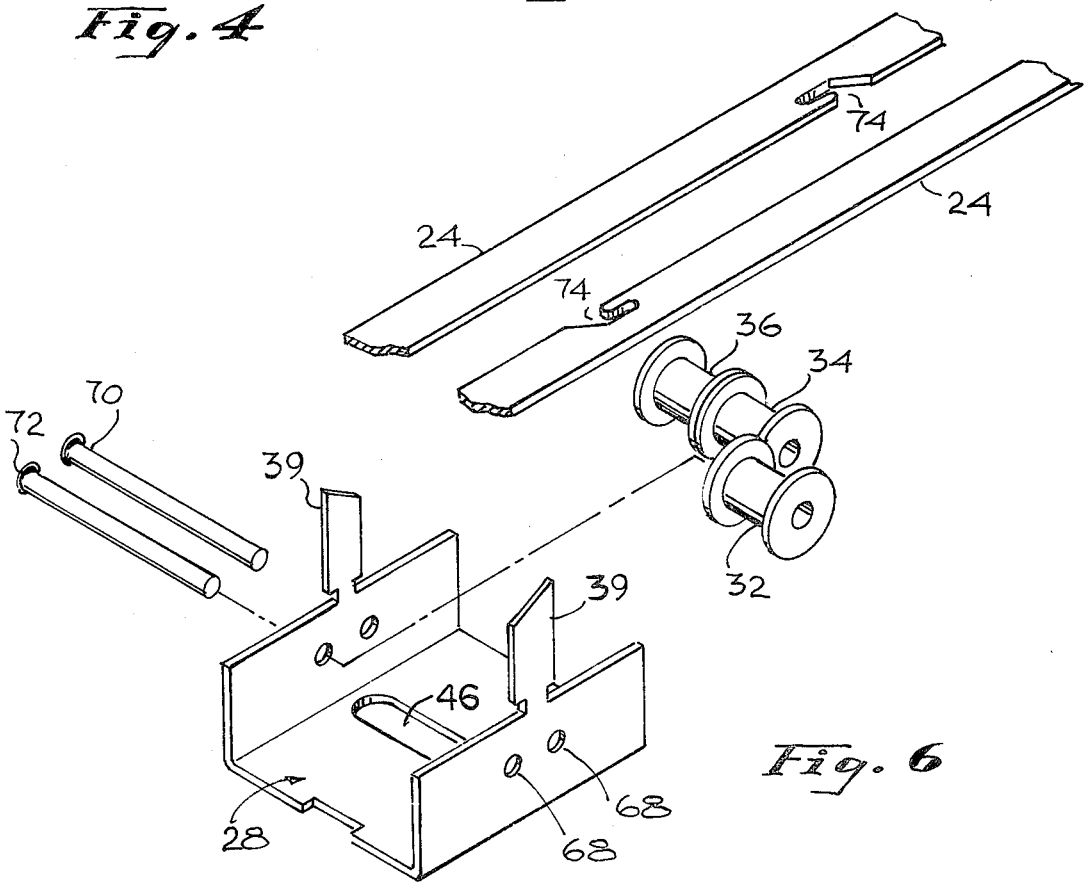
FIG. 6 is an exploded view of the ladder connections.

In FIG. 6, an exploded view of the tilt and lift assembly, cradle 28 has holes 68 which are positioned for locating pins 70 and 72. Pulleys 36 and 34 rotate about rod 70, when in position, and pulley 32 rotates about rod 72. The positioning of the pulleys results in pulley 34 acting as a spacer between pulleys 32 and 36, and thus controlling the relative positioning of tilt bars 24, since tilt bars 24 ride in the pulleys. In addition, pulleys 32 and 36 perform the function of positioning the tilt ladder strings (see FIGS. 3 and 4) which pass through indentations 74 in tilt bars 24. As described above, pulley 34 acts as the position pulley for lift cord 22, not shown, allowing lift cord 22 to freely travel through orifice 46 in cradle 28, while pulleys 32, 36 perform a similar function for the tilt ladder strings.

Figure 7B:
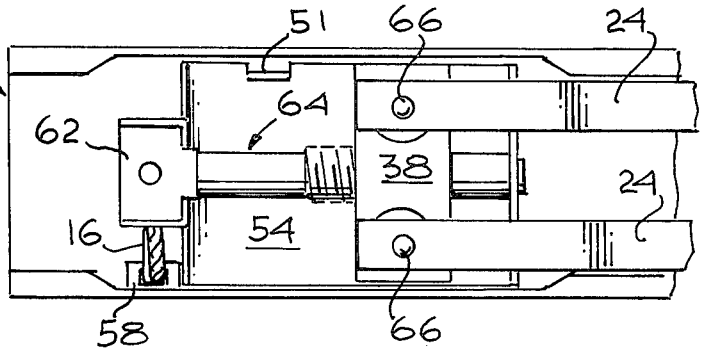
FIGS. 7A–7C are views of an assembled tilt mechanism.
Figure 7C:
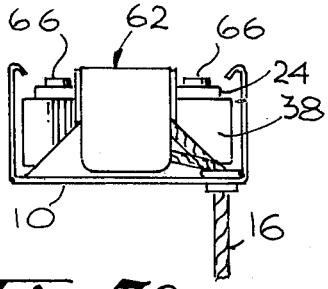
Figure 7A:
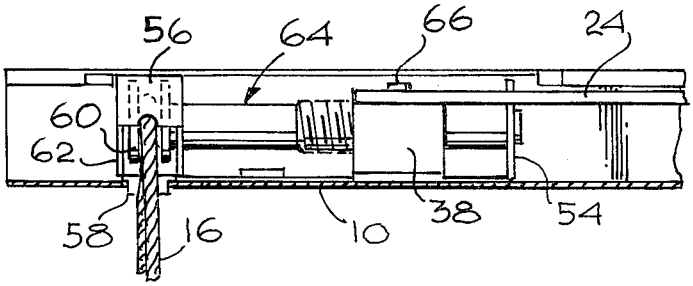

The assembled tilt mechanism is depicted in FIGS. 7A–7C. As shown, tilt bars 24 are positioned and retained adjacent carrier 38 through posts 66. Carrier 38 is operated by rotation of threaded rod 64 which is positioned in housing 54. Housing 54 is retained in headrail 10 through tabs 51. To operate the tilt mechanism, one end of tilt cord 16 is pulled downward resulting in the rotation of pulley 60 in pulley cover 62. This rotation of the pulley rotates threaded rod 64 which moves carrier 38 and associated tilt bars 24.

Figure 8A:
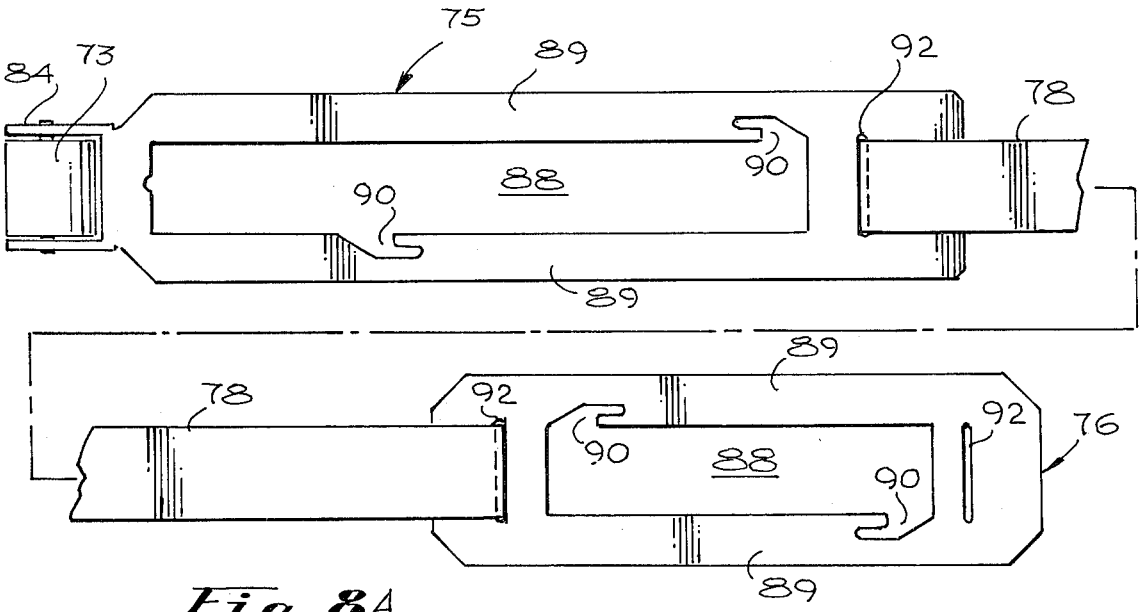
FIGS. 8A–8B are views showing details of an alternative arrangement of the tilt mechanism.
Figure 8B:
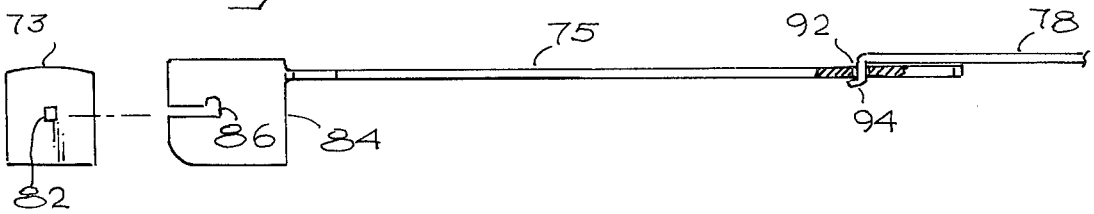
Figure 9:
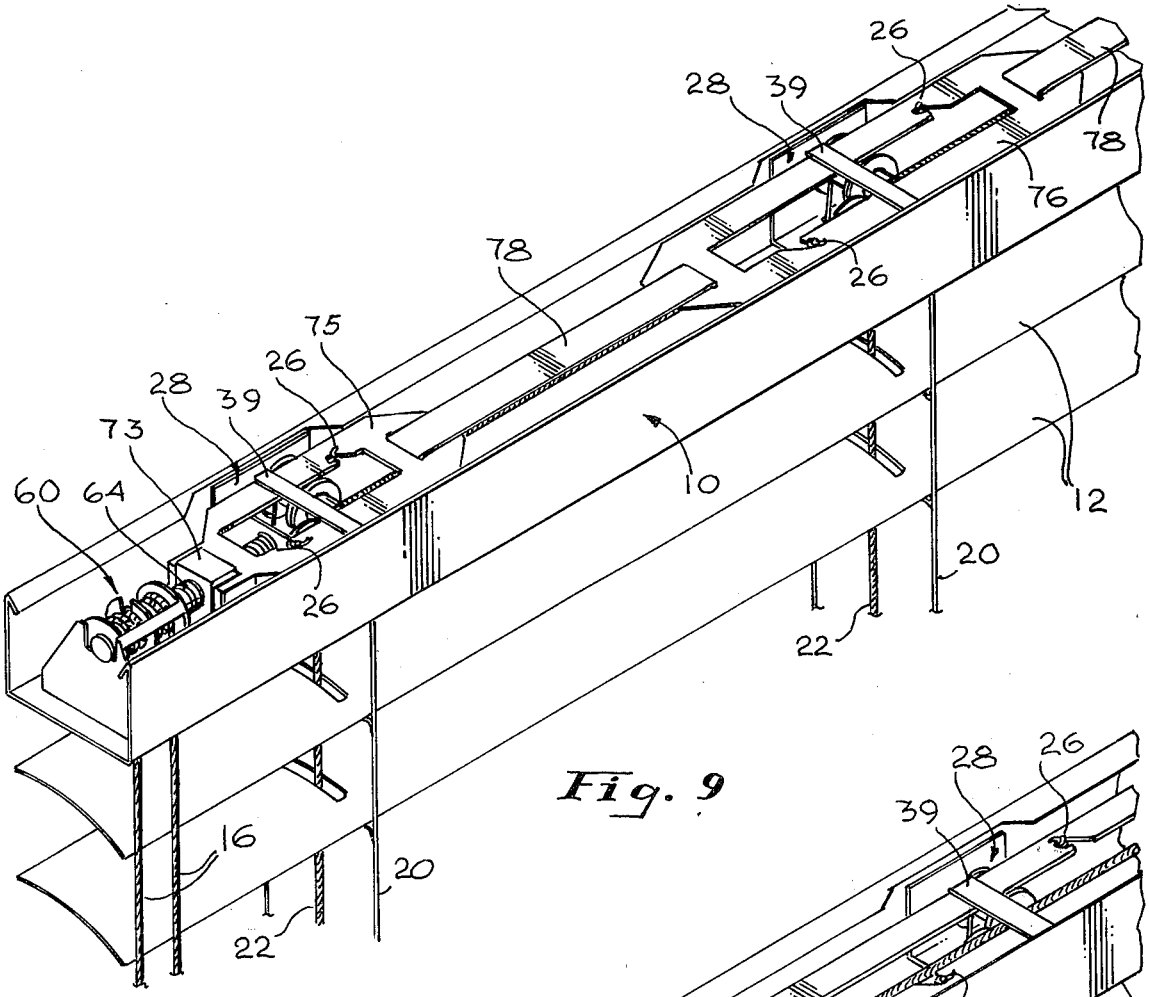
FIG. 9 is an open isometric view (headrail cover and end removed) showing the interrelationship of the various mechanisms making up the alternative embodiment of FIGS. 8A and 8B.

FIGS. 8A and 8B are respectively plan and side elevational views of an alternative tilt drive mechanism for use in embodiments in the present invention. The overall mechanism is shown in FIG. 9. The depicted alternative arrangement basically comprises a carrier 73, at least two ladder string anchor members 75 and 76, at least one of which is configured to engage the carrier 73, and one or more coupled spacer bars 78. As best shown in FIG. 8B, the carrier 73 has an internally threaded bore for engaging a threaded shaft such as 64 of FIG. 5, and a pair of protruding shoulders 82 for pivotably engaging the member 75. The member 75 has downwardly depending sides 84 with shaped keyways 86 for receiving and retaining the shoulders 82 of the carrier 72 upon assembly.

The members 75 and 76 are each provided with elongated central apertures 88, thus defining elongated side portions 89 which are equivalent to the tilt bars 24 of the previously described embodiment. The ladder strings may be retained in slots 90, as by anchor beads or the like, in the manner already described. Thus, each of the ladder string retaining members 75, 76 cooperates with the remaining structure of the Venetian blind, particularly the headrail and tilt mechanism, in equivalent fashion to the operation of the tilt bar mechanism of FIGS. 2–4. The members 75, 76 are linked together for transverse movement in either direction, as driven by the carrier 73 and associated tilt drive mechanism, by means of an elongated strip or spacer bar 78. This strip 78 is of a proper length to space the members 75, 76 in position adjacent the respective slat support ladders. Venetian blinds are manufactured in a variety of widths and therefore the spacer strip 78 may be fabricated in corresponding lengths to accommodate different spacing between adjacent ladder strings. For ease of assembly (and disassembly) in the manner shown, each member 75, 76 is provided with a slot 92 for receiving and retaining the spacer strip 78. Moreover, each end 94 of the spacer strip 78 is S-shaped (see FIG. 8B) for positively engaging the adjacent members 75 or 76 in a manner which transmits force to push or pull the mechanism as the carrier 73 is driven to the right or to the left by the tilt mechanism.

Venetian blinds extending beyond a given width may be provided with three or more ladder string sets. To accommodate such a structure, additional string anchor members 76 may be provided beyond the portion of the mechanism shown in FIG. 8A and coupled therewith by means of additional spacer strips 78 extending from the right-hand slot 92 of the member 76 in the manner already described. Although not shown, other means of coupling the spacer strips to the anchor members may be provided, if desired, as, for example, rivets, screws, pins, etc.

Provision of the alternative tilt drive mechanism of FIGS. 8A and 8B advantageously simplifies the assembly procedure for Venetian blinds employing embodiments of the present invention while reducing the extent and cost of the parts inventory which must be maintained for the production of Venetian blinds of varying widths. Instead of requiring pairs of tilt bars individually dimensioned for every different width of blind being manufactured, the fabricator may use the anchor members 75, 76 which are common for all blinds, and utilize spacer bars 78 of modular dimensions for the different widths. As the Venetian blinds employing more than two ladder string sets are fabricated, it is possible to use the same elements which are needed for the Venetian blinds having only two ladder string sets. Thus the cost of such Venetian blinds may be reduced.

Although there have been described above specific arrangements of tilt and lift mechanisms for Venetian blinds in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A Venetian blind having a plurality of slats supported in a spaced relationship by a support structure comprising:

a headrail;

at least a pair of lift strings threaded through the slats in positions displaced longitudinally of the headrail on opposite sides of the center plane of the blind, traversing the headrail over guide means, and exiting the headrail;

at least a pair of tilt ladders having strings positioned adjacent said lift strings, adapted to support and tilt said slats, and passing into said headrail;

drive means including drive members connected to the tilt ladders, the drive members being connected together to move in unison longitudinally in the same direction to effect tilting of said slats, and a carrier coupled to at least one drive member and threadably engaging a pulley shaft;

a shaft and associated drive pulley, the shaft being oriented longitudinally of the headrail and threaded along at least part of its length for engaging the carrier; and a tilt string coupled to rotate the drive pulley;

the carrier and shaft being effective to translate rotation of said pulley to longitudinal movement of the drive members.

2. The blind of claim 1 wherein the carrier and shaft comprise a threaded rod and internally threaded carrier associated therewith.

3. The blind of claim 1 wherein the shaft extends in both directions beyond the threaded portion and is adapted to permit continued rotation of the shaft without driving the carrier past a predetermined position.

4. The blind of claim 3 including means for developing a biasing force on the carrier to cause re-engagement with the threaded portion of the shaft upon reversal of the direction of rotation of the shaft and pulley.

5. The blind of claim 1 further comprising rotatable support means for the drive members.

6. The blind of claim 5 further including means for feeding the strings of the tilt ladders over respective ones of the support means to provide rolling movement of the tilt ladder strings through a change of angular direction as the drive members are moved longitudinally over said support means.

7. The blind of claim 6 further including lift string pulleys spaced between the support means for supporting the lift strings without sliding friction as the lift strings are moved to raise or lower the blind.

8. The blind of claim 6 wherein each drive member comprises a pair of elongated strips on opposite sides of an elongated central aperture, each strip including a tapered slot for retaining an associated ladder string.

9. The blind of claim 8 wherein the ladder string drive members and ladder string slots are so configured and positioned relative to the rotatably support means that as a drive member is driven longitudinally, one of the strings of a ladder is let out while the other string is drawn in to the headrail.

10. The blind of claim 1 wherein the drive members comprise a pair of spaced apart bars.

11. The blind of claim 10 further comprising support means for each bar adjacent each ladder.

12. The blind of claim 8 including pulley means mounted to guide and support said bars and to support the strings of said ladder.

13. The blind of claim 12 wherein, said pulley means and said bars are positioned in a cradle affixed to the headrail.

14. The blind of claim 12 further including a lift string support pulley rotatably mounted between the bar support pulley means and spacing the pulley means from each other.

15. The blind of claim 1 wherein the drive members comprise at least a pair of ladder string anchor members and at least one spacer bar releasably attached between the anchor members.

16. The blind of claim 15 further including means on one of the anchor members for releasably coupling to the carrier.

17. A tilt mechanism for Venetian blinds comprising:

a threaded rotatable rod;

a pulley operatively attached to said rod and adapted to be driven by a tilt string to rotate said rod;

an internally threaded carrier mounted on said rod and movable longitudinally of the rod in response to rotation of said rod;

tilt means coupled to said carrier and extending longitudinally from said carrier over associated tilt ladders, the tilt means comprising at least a pair of drive members coupled together to move in unison in the same direction in tilting the tilt ladders; and plural paired tilt ladder strings coupled to said tilt means at opposed lateral positions thereon and adapted to laterally position and tilt plural slats of said blind, whereby rotation of said rod by said pulley longitudinally moves said carrier and said tilt means and simultaneously lifts one string of each pair of tilt ladder strings while lowering the other string of each pair.

18. The mechanism of claim 17 wherein said tilt means comprises a pair of spaced-apart elongate members and each one of the tilt ladder strings is attached to a corresponding member.

19. The mechanism of claim 18 wherein a first one of each pair of tilt ladder strings traverses first pulley means associated with one member and is attached to said member at a first lateral position, and the second string of each pair traverses second pulley means associated with the second member and is attached to said second member at a second lateral position opposed to said first lateral position.

20. The mechanism of claim 17 wherein the tilt means comprise a pair of tilt bars coupled to the respective pairs of tilt ladder strings, each bar being coupled to a corresponding string of each pair in a manner to cause lifting of one string of each pair by one bar and the lowering of the other string of each pair by the other bar as the tilt bars are moved by the carrier.

21. The mechanism of claim 1 or claim 17 wherein the drive members comprise at least two ladder string anchor members interconnected by a removable spacer bar, the spacer bar being dimensioned to position the anchor members adjacent respective pairs of tilt ladder strings of a Venetian blind having a corresponding dimension between ladder string pairs.

22. The mechanism of claim 21 wherein each anchor member is configured to receive one end of an associated bar in locking relationship.

23. The mechanism of claim 22 wherein the anchor members and spacer bars are configured to permit the coupling of additional spacer bars and anchor members in line along the top of the Venetian blind for facilitating the fabrication of Venetian blinds having more than two pairs of ladder strings.

24. The mechanism of claim 21 wherein the anchor member adjacent the carrier is configured to releasably engage the carrier for driving movement therewith.

25. The mechanism of claim 17 wherein the rotatable rod is threaded only along a central portion thereof and the carrier is adapted to move to one end or the other of said threaded portion without being driven further during continued rotation of the rod.

* * * * *